United States Patent [19]

Asak

[11] Patent Number: 4,860,838

[45] Date of Patent: Aug. 29, 1989

[54] LATCHING BIT SUB

[75] Inventor: Kare Asak, Calgary, Canada

[73] Assignee: Drill Systems International Ltd., Calgary, Canada

[21] Appl. No.: 283,196

[22] Filed: Dec. 12, 1988

[51] Int. Cl.[4] ..... E21B 17/046; E21B 17/06

[52] U.S. Cl. ..... 175/320; 285/18; 285/319; 294/86.31; 294/86.32; 403/290

[58] Field of Search ..... 175/257, 320, 202, 309; 285/18, 39, 319; 403/289, 290, 329, 322, 11; 294/86.26, 86.31, 86.32, 100

[56] References Cited

U.S. PATENT DOCUMENTS

| | | | |
|---|---|---|---|
| 2,252,767 | 8/1941 | Hudson | 294/86.31 |
| 3,604,746 | 9/1971 | Notari | 294/86.32 X |
| 3,746,093 | 7/1973 | Mullins | 166/217 |
| 3,863,715 | 2/1975 | Yonker | 166/217 |
| 3,955,633 | 5/1976 | Bowles | 175/258 |
| 4,232,888 | 11/1980 | Amancharla | 285/18 |
| 4,407,364 | 10/1983 | Johnston | 166/217 |
| 4,488,596 | 12/1984 | Akkerman | 166/217 |
| 4,708,524 | 11/1987 | Goris | 403/322 X |

FOREIGN PATENT DOCUMENTS

| | | |
|---|---|---|
| 0435307 | 6/1946 | Canada . |
| 0797108 | 10/1968 | Canada . |
| 0885822 | 11/1971 | Canada . |
| 1003748 | 1/1977 | Canada . |

*Primary Examiner*—Stephen J. Novosad

*Attorney, Agent, or Firm*—Hayes, Soloway, Hennessey & Hage

[57] ABSTRACT

A drill bit latch assembly for releasably securing an earth drill bit to the bottom end of a drill string comprises a tubular housing adapted to be secured to the bottom end of a tubular drill string, drill bit holder adapted to be secured to a drill bit, and a latch assembly. The drill bit holder is telescopically movably received in one end of the housing and coupled thereto for rotation with the housing. The latch assembly is telescopically received in the other end of the housing. The latch assembly releasably engages the holder and is operative with the housing for maintaining the holder in a predetermined operative position within the housing. The latch assembly is responsive to an unlatching tool lowered down the drill string to unlatch the holder.

17 Claims, 4 Drawing Sheets

LATCHING BIT SUB

This invention relates, in general, to drilling in earth formations and, more specifically, to a drill bit latching sub for securing a drill bit to the bottom end of a dual-wall drill string, used in reverse circulation drilling, in such a manner that the drill bit can be released from the drill string without extraction the drill from the borehole.

BACKGROUND OF THE INVENTION

Once a borehole has been drilled to the desired depth in an earth formation, it is necessary to lower anchors, tubing or other drill tools to the bottom of the borehole. Such devices frequently cannot pass through the drill bit and, heretofore, it has been necessary to extract the entire drill string in order to remove the drill bit. This is a time consuming and expensive process. This is particularly problematic if the earth formation is loose or unconsolidated because the borehole may cave in if the drill string is removed. To avoid this, means must provided to reinforce the borehole. This is also time consuming and expensive.

Canadian Patent No. 435,307, issued to C. Kaezor on June 18, 1946, discloses a rock drill bit having a spring wire device which facilitates assembly and disassembly of the bit in a shank or holder. This device cannot be released from a remote location, i.e. while the drill string bit is in a borehole. The drill string must be removed from the hole to release the bit.

Thus, there is a need for a drill bit latching arrangement which will allow a drill bit to be disengaged from the surface while the drill string is in situ to allow other tools and/or devices to be lowered to the bottom of the borehole.

SUMMARY OF THE INVENTION

The primary object of the present invention is to provide a relatively simple drill bit latch sub which normally secures a drill bit to the bottom of a drill string and allows drilling to proceed in the usual manner and yet can be made to readily release the drill bit when required without raising the drill string.

In accordance with the present invention, there is provided a drill bit latch assembly for releasably securing an earth drill bit to the bottom end of a drill string. The assembly comprises a tubular housing adapted to be secured to the bottom end of a tubular drill string, drill bit holder means adapted to be secured to a drill bit, and a latch means. The holder means is telescopically movably received in one end of the housing and coupled thereto for rotation with the housing. The latch means is telescopically received in the other end of the housing. The latch means releasably engages the holder means and is operative with the housing for maintaining the holder means in a predetermined operative position within the housing. The latch means is responsive to an unlatching tool lowered down the drill string to unlatch the holder means.

BRIEF DESCRIPTION OF THE DRAWINGS

These and other features of the invention will become more apparent from the following description of a preferred embodiment of the invention in which reference is made to the appended drawings, wherein.

DESCRIPTION OF PREFERRED EMBODIMENT

Figure 1:
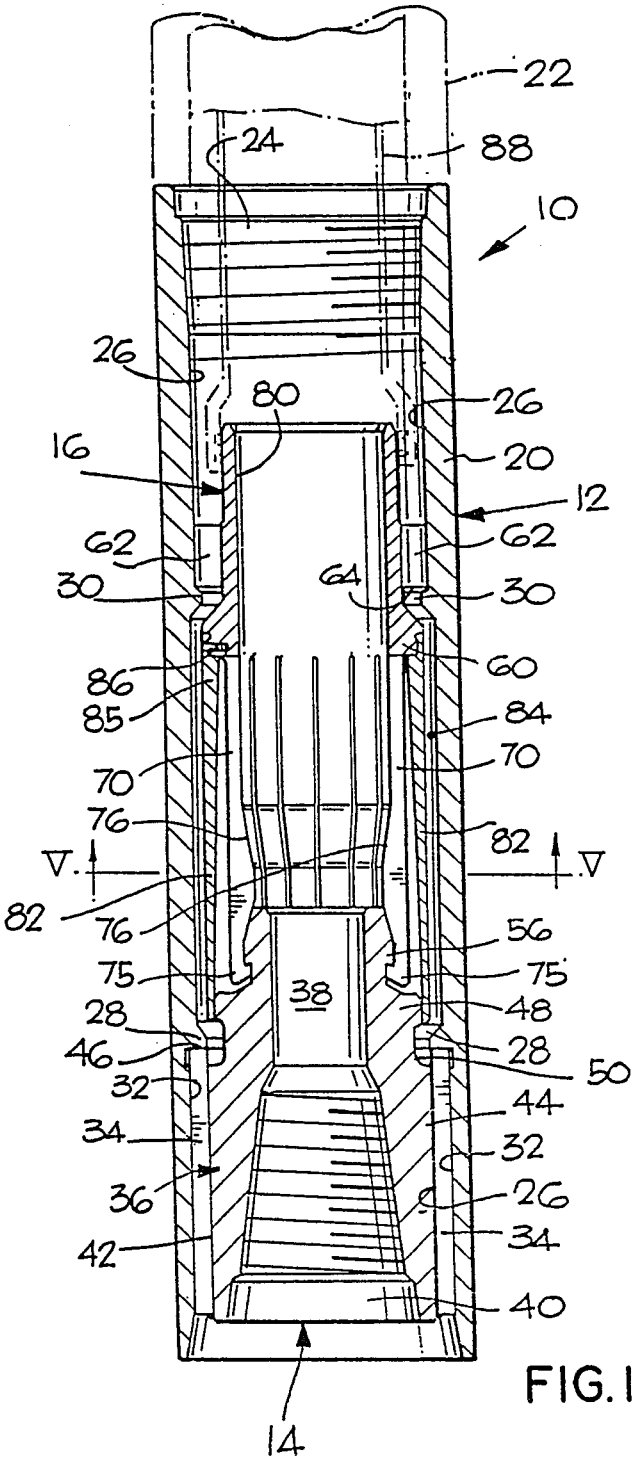
FIG. 1 is a longitudinal cross-section view of a drill bit latch assembly in drill bit latching position.
Figure 3:
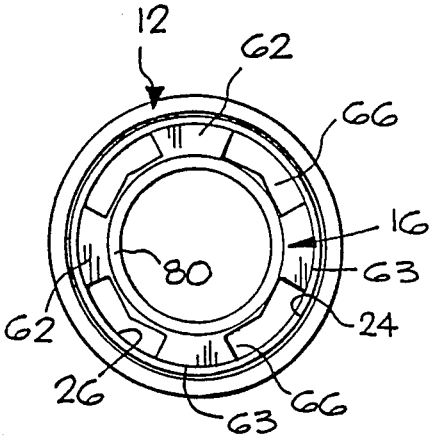
FIG. 3 is a top end view of the assembly of FIG. 1.
Figure 4:
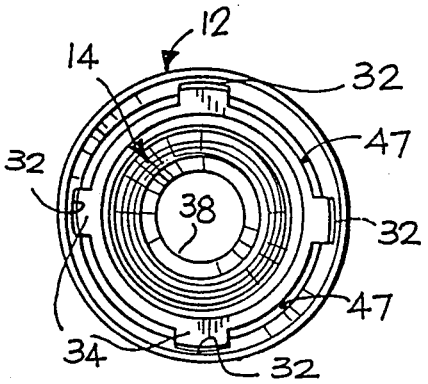
FIG. 4 is a bottom end view of the assembly of FIG. 1.
Figure 5:
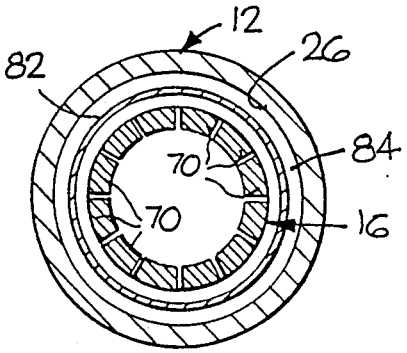
FIG. 5 is a cross-sectional view taken generally along line V—V of FIG. 1.

Referring to the drawings, the preferred embodiment of the latching bit sub assembly 10 of the present invention includes three basic components, namely an elongated, tubular sub body 12, a drill bit adaptor or holder 14 and a latch assembly 16. As explained more fully hereinafter, the drill bit adaptor is telescopically received in the bottom end of the sub body, seated against a first shoulder in the sub body coupled to the sub body for rotation therewith. The latch assembly is telescopically received in the upper end of the sub body and seated against a second shoulder. The drill bit adaptor and latch assembly releasably engage one another to prevent axial outward movement of either member while engaged. The two members may be disengaged and the drill bit thereby released simply by lowering an unlatching tool down the drill string.

Sub body 12 is in the form a tubular housing or body 20 having the same external dimensions as the outer casing 22 of a conventional dual wall drill string and includes an internally threaded top end 24 for threaded engagement with the externally threaded bottom end of the outer casing. Sub body 12 is formed with a bore 26 having an inwardly extending annular shoulder 28 for axially locating drill bit holder 14 within the sub body against upward movement and an axially spaced annular shoulder 30 for axially locating latch assembly 16 within the sub body against downward movement. Four equally angularly spaced, rectangular slots or grooves 32 are formed in bore 26 of the sub body and extend longitudinally from shoulder 28 to the bottom end of the sub body. Slots 32 are adapted to slidingly receive mating rectangular splines 34 formed on the drill bit adaptor so that the drill bit adaptor is thereby secured to the sub body for rotation therewith.

Figure 6:
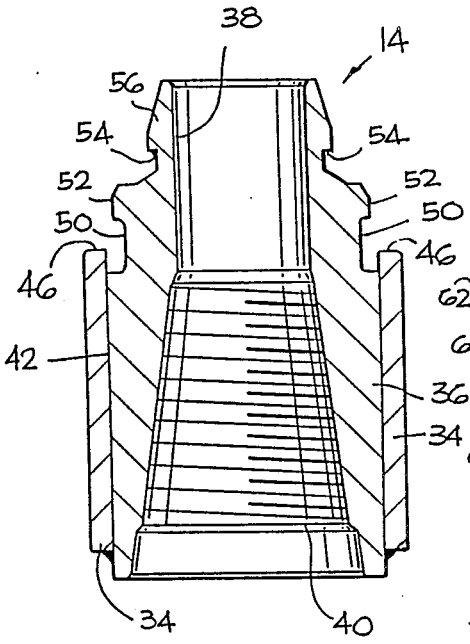
FIG. 6 is a longitudinal cross-sectional view of a bit holder used in the assembly of FIGS. 1 to 5.

With reference to FIG. 6, drill bit adaptor 14 is in the form of a tubular body 36 having a bore 38 defining an axial fluid passage. The bottom end 40 of the bore is threaded for engagement with the externally threaded end of a conventional drill bit (not shown). Four longitudinally extending splines 34 are welded to the cylindrical outer surface 42 of the bottom end portion 44 of the drill bit adaptor for reception within slots 32 formed in the sub body as explained above. As best shown in FIG. 1, the upper ends 46 of splines 34 engage annular shoulder 28 when the drill bit adaptor is fully inserted into the bottom end of the sub body. The outer diameter of the bottom end of th drill bit adaptor is smaller than the inner diameter of the bottom end of the sub body so as to provide an annular fluid passage 47 therethrough during reverse circulation.

The upper end 48 of drill bit adaptor 14 is of reduced diameter with respect to the bottom end to allow the upper end to extend upwardly into the sub body beyond shoulder 28. The upper end includes a circumferential recess 50, a circumferential seat 52, a downwardly facing latching finger engaging shoulder 54 and an upwardly and inwardly tapering head 56. Recess 50 simply provides an annular fluid passage passed shoulder 28. Seat 52 receives the bottom end of a sleeve described more fully below. Shoulder 54 is engaged by hooks formed at the free end of each of a plurality of latching fingers described below. Shoulder 54 and the hooks are slightly conical so that axial separating forces applied during engagement urges the members into tighter engagement.

Figure 7:
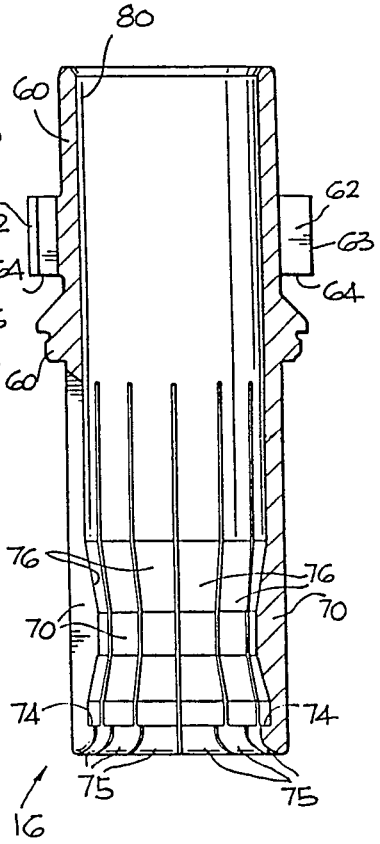
FIG. 7 is a longitudinal cross-sectional view of a latch body used in the assembly of FIGS. 1 to 5.
Figure 8:
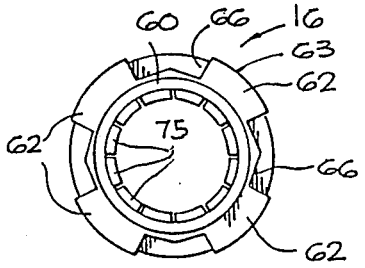
FIG. 8 is a plan view of the latch body of FIG. 7.
Figure 9:
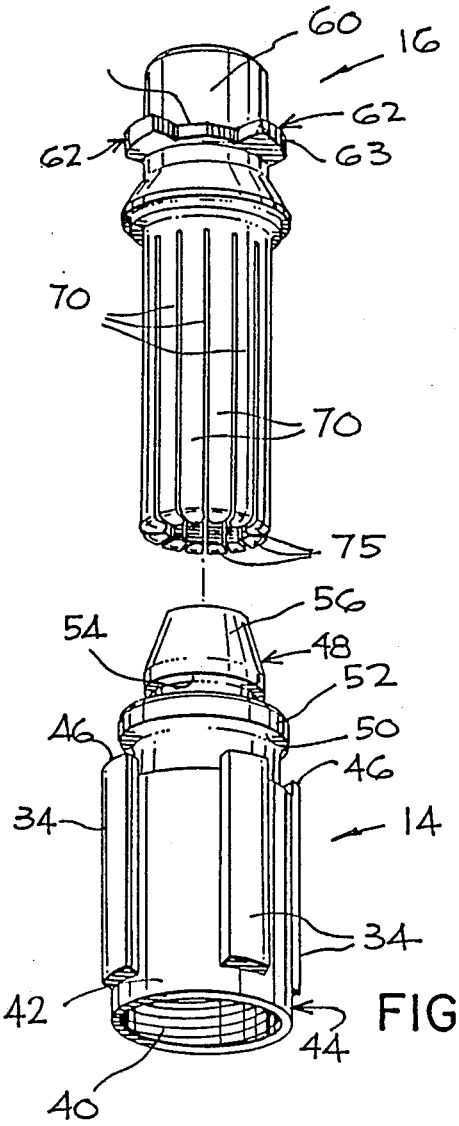
FIG. 9 is a schematic exploded, perspective view, from below, of the bit holder and tube of FIGS. 6 and 7 in the unlatched condition.

With particular reference to FIG. 7, latch assembly 16 includes a cylindrical tubular latch body 60 having four equally angularly spaced, radially outwardly extending projections 62. Outer surfaces 63 of the projections are arcuate and centered on the axis of body 60 and are dimensioned for sliding reception within the bore 26 of the sub body. Thus, the projections serve to keep latch body 60 concentrically disposed within the sub body. The undersides of projections 62 define shoulders 64 which engage shoulder 30 of the sub body to axially locate the latch assembly within the sub body. The spaces between the projections serve to define axial fluid passages 66.

A plurality of identical, elongated latching fingers 70 extend from bottom end of latch body 60. The free end of each finger is formed with an inwardly extending hook 72 defining an inwardly extending and slightly upwardly inclined hook surface 74. Hook surfaces 74 engage shoulder 54 when both the drill bit adaptor 14 and latch assembly 16 are in their operative positions. As shown in FIG. 7, the bottom ends 75 of the latching fingers are inwardly tapered or curved so that during installation, ends 75 engage the tapered outer surface of head 56 of the bit holder and, as the two components are moved toward one another, the fingers will resiliently flex outwardly until they snap into place in engagement with shoulder 54. The natural resilient of the fingers and the slight inclination of the mating shoulders of the fingers and shoulder 54 of the drill bit adaptor 14 maintain the two components in engagement. The inner surface of each finger 70 is formed with an inwardly and downwardly extending cam surface 76 which provide the means by which the latch assembly may be unlatched. Thus, when an unlatching tool such as a rod 78 (see FIG. 2) is inserted into the bore 80 of the latch body 60, the rod engages cam surfaces 76 and forces the free ends of the latch fingers radially outwardly, against their natural resilience, out of engagement with shoulder 54.

Figure 2:
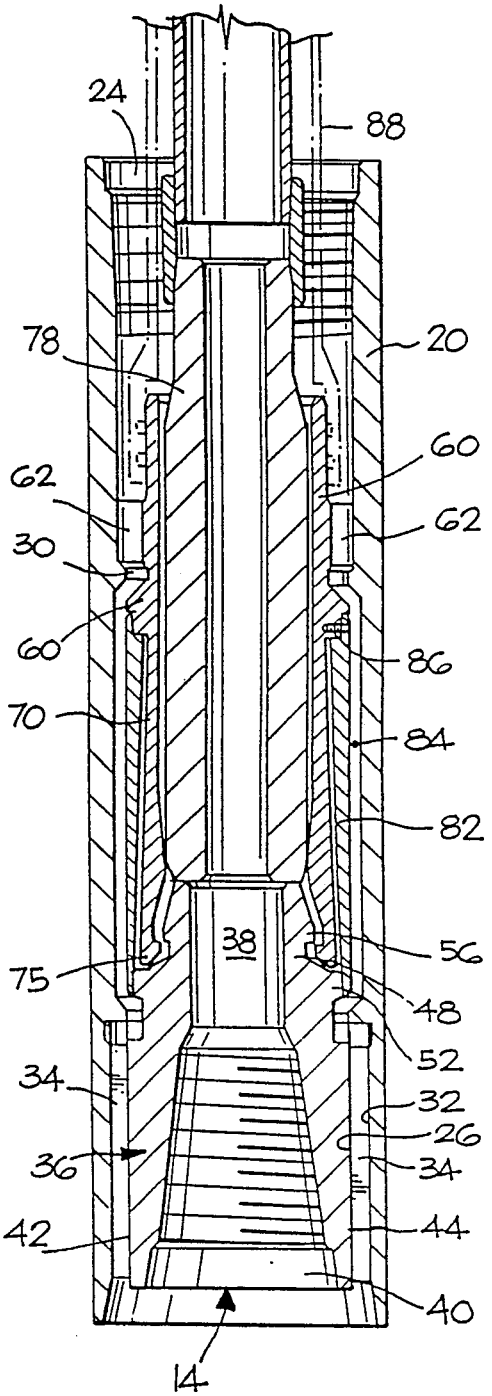
FIG. 2 is a longitudinal sectional view of the assembly of FIG. 1 in a drill bit unlatching position.

Referring to FIGS. 1 and 2, a sleeve 82 concentrically surrounds or houses the latching fingers and, with bore 26 of sub body 12, defines an outer, annular fluid passage 84. Sleeve 82 prevents the flow of fluid from the interior of the latch body into the passage 84 and vice versa. One end 85 of the sleeve is secured to latch body 60 by spring pins 86 or the like. The opposite end of the sleeve telescopically receives seat 52 of the drill bit adaptor with a slight clearance being provided therebetween to permit a slight leakage of fluid in order to prevent clogging.

As shown in phantom lines in FIGS. 1 and 2, the upper end of the latch assembly 16 is dimensioned to be telescopically received in sealed relation within the end of the conventional inner tube or casing 88 of the dual-wall drill string.

To assemble the latching bit sub assembly, the splines on the drill bit adaptor 14 are aligned with the slots in the bottom end of the sub body and then the drill bit adaptor is telescopically slid into the bore of the sub body until ends 46 of splines 34 engage shoulder 28. Similarly, latch assembly 16 is inserted into the upper end of the sub body and telescopically slid inwardly until shoulders 64 on projections 62 of the latch assembly engage shoulder 30 in the sub body. As this occurs, ends 75 of hooks 72 on the latching fingers ride up onto tapered end 56 of the holder and snap into engagement with shoulder 54 on the drill bit adaptor. Such engagement prevents both the drill bit adaptor and latch assembly from axially separating while shoulders 28 and 30 prevent the two members from moving axially inwardly toward one another. The drill bit may now be threadedly engaged with the drill bit adaptor, if it has not already been so engaged, and the upper end of the assembly may be threaded onto the bottom end of the outer casing of the drill string.

During a normal drilling operation, sub body 12, drill bit adaptor 14, the drill bit secured thereto, and latch assembly 16 rotate with the drill string. Drilling mud flows downwardly through the annular passage between the inner and outer pipes of the drill string, through the annular passages between bore 26 and the outer surfaces of the latch assembly and the drill bit holder and into the bottom of the borehole. Drilling mud and cuttings are returned to the surface through openings (not shown) bore 38 in the drill bit holder, bore 80 in the latch body and into the inner passage of the inner pipe of the drill string.

Once the borehole has been drilled to the desired depth, drilling is stopped and the drill string is raised a short distance from the bottom of the hole. A release rod 78 is fed down the bore of the inner tube of the drill string and introduced into the bore 80 of the latch assembly. As the rod continues into the bore, it engages cam surfaces 76 and causes the bottom ends of the fingers 70 to flex outwardly until hooks 72 move out of engagement with shoulder 54. When this occurs, the drill bit adaptor and the drill bit will drop, under gravity, to the bottom of the borehole. Rod 78 can be removed and the desired tool can be introduced into the hole through the drill string.

It will be appreciated that various modifications and modifications may be made to the present invention without departing form the spirit of the invention as defined in the following claims.

The embodiments of the invention in which an exclusive property of privilege is claimed are defined as follows:

1. A drill bit latch assembly for use in an earth drilling apparatus, said assembly comprising:

a tubular housing for mounting on the bottom end of a tubular drill string;

holder means for carrying a drill bit, said holder means being axially movable within said housing between a latched position and the bottom end of said housing and being coupled to said housing for rotation therewith; and tubular latch means concentrically disposed within said housing in a drill bit holder latching position, said latch means being operable to engage said holder means disposed in said latched position for normally retaining said bit holder means in said position and being responsive to an unlatching tool inserted into said latch means to release said holder means and thereby permit said holder means and a drill bit secured thereto to drop out of said housing under the influence of gravity.

2. A drill bit latch assembly according to claim 1, said latch means including a tubular body means, resilient finger means extending axially from said body means toward the bottom of said housing and having hook means engageable with mating shoulder means on said holder means and cam means extending radially inwardly from said finger means for engagement with an unlatching tool operable to urge said fingers out of engagement with said shoulder means.

3. A drill bit latch assembly according to claim 2, said housing including first shoulder means for limiting axially inward movement of said holder means within said housing and second shoulder means for limiting axially inward movement of said latch means into said housing.

4. A drill bit latch assembly according to claim 2, said holder means having longitudinally extending spline means on the outer surface thereof, said housing having longitudinal groove means in an inner surface thereof matingly engageable with said spline means for non-rotatably coupling said holder means said housing.

5. A drill bit latch assembly according to claim 2, said fingers means being integral with said body means and said cam means is integral with said finger means.

6. A drill bit latch assembly according to claim 5, said latch body means including radially outwardly extending lug means engageable with the inner surface of said housing for centering the latch means in said housing.

7. A drill bit latch assembly for releasably securing an earth drill bit to the bottom end of a drill string, said assembly comprising:

a tubular housing adapted to be secured to the bottom end of a tubular drill string;

drill bit holder means adapted to be secured to a drill bit, said holder means being telescopically movably received in one end of said housing and coupled thereto for rotation therewith; and latch means telescopically received in the other end of said housing, said latch means being releasably engageable with said holder means and being operative with said housing for maintaining said holder means in a predetermined operative position in said housing, said latch means being responsive to an unlatching tool received therein for releasing said holder means.

8. A drill bit latch assembly as defined in claim 7, said latch means including a tubular body means coaxially disposed in a predetermined position within said housing, resilient finger means extending axially from said body means toward said one end of said housing for engaging shoulder means on said bit holder means for normally axially retaining said holder in said housing.

9. A drill bit latch assembly as defined in claim 8, said finger means further including cam means extending radially inwardly from said finger means for engagement with an unlatching tool inserted into said body means, said unlatching tool being operative to force the free ends of said finger means outwardly to cause said finger means to release said holder means.

10. A drill bit latch assembly as defined in claim 9, said finger means having inwardly extending hook means at the free ends thereof, each said hook means having surface means engageable with annular shoulder means on said holder means, said surface means and said shoulder means being inclined at a slight angle with respect to a radial plane whereby opposed tensile forces applied to said holder means and said latch tend to urge said surface means and said shoulder means into tighter engagement.

11. A drill bit latch assembly as defined in claim 7, said latch means further including sleeve means extending between said body means and said holder means and surrounding said finger means, said sleeve means defining an annular fluid flow passage between the outer surface thereof and the inner surface of said housing.

12. A drill bit latch assembly as define din claim 7, said housing having first shoulder means co-operable with mating shoulder means on said holder means for axially positioning said holder means in said housing.

13. A drill bit latch assembly as defined in claim 7, said housing having first shoulder means co-operable with mating shoulder means on said latch means for axially positioning said latch means in said housing.

14. A drill bit latch assembly as defined in claim 7, said housing having first shoulder means co-operable with mating shoulder means on said holder means for axially positioning said holder means in said housing and second shoulder means co-operable with mating shoulder means on said latch means for axially positioning said latch means in said housing.

15. A drill bit latch assembly as defined in claim 7, said holder means having an axial passage extending therethrough for communicating fluid between said latch means and said drill bit.

16. A drill bit latching sub for releasably securing an earth drill bit to the bottom end of a dual-wall drill string, said assembly comprising:

a tubular housing adapted to be secured to the bottom end of a tubular drill string, said housing having inner and outer substantially cylindrical surfaces, first and second axially spaced annular shoulder means on said inner surface and longitudinal groove means on said inner surface extending from said second shoulder means to one end of said housing;

tubular drill bit holder adapted to be secured to a drill bit, said holder means having splines means matingly engageable with said groove means for non-rotatably coupling said holder means and said housing, shoulder means matingly engageable with said second shoulder means for axially locating said holder means in a predetermined axial position in said housing, a central passage for communicating fluid axially thereof, outer surface means defining with said housing a first annular fluid passage, and annular latching shoulder means; and latch means telescopically received in the other end of said housing, said latch means having a tubular body means slidingly and telescopically received within said housing inner surface and being engageable with said first shoulder means in said housing for locating said latch means in a predetermined axial position, fluid passage means in said body means communicating with said central passage means in said holder means, sleeve means having one end concentrically secured to said body means and the other end telescopically receiving one end of said holder means and defining with said body means a second annular fluid passage communicating with said first fluid passage, and integral, resilient latching finger means extending from said latch body means toward said holder means and disposed within said sleeve means in concentric relation thereto, said finger comprising a plurality of elongated resilient latching finger, each said finger having a free end remote from said latch body, hook means at each said free end, said hook means having a substantially radially extending hook surface engageable with said annular latching shoulder means, each said finger means having an inner surface and cam surface means extending inwardly therefrom for engagement with an unlatching tool introduced into said latch body, said latching tool being operative to force said free ends of said finger means outwardly out of engagement with said latching shoulder means whereby to disengage said latch means from said holder means.

17. A drill bit latch assembly as defined in claim 16, said hook means surface means and said latching shoulder means being inclined at a slight angle with respect to a radial plane whereby opposed tensile forces applied to said holder means and said latch tend to urge said surface means and said shoulder means into tighter engagement.

* * * * *